US006147612A

United States Patent [19]

Ruan et al.

[11] Patent Number: 6,147,612

[45] Date of Patent: Nov. 14, 2000

[54] DUAL FUNCTION OPTIC SLEEP PREVENTING DEVICE FOR VEHICLE DRIVERS

[76] Inventors: Ying Chao Ruan; Jing Qing Tang, both of 7415 Ash Ave., Raytown, Mo. 64133

[21] Appl. No.: 09/437,922

[22] Filed: Nov. 10, 1999

[51] Int. Cl.[7] ..... G08B 23/00

[52] U.S. Cl. ..... 340/575; 340/573.1; 340/573.4; 340/576; 340/691; 340/693

[58] Field of Search ..... 340/575, 576, 340/573.1, 573.4; 364/419.2, 550, 569; 200/61.45 R, 61.52

[56] References Cited

U.S. PATENT DOCUMENTS

| | | | |
|---|---|---|---|
| 3,863,243 | 1/1975 | Skolnick et al. | 340/279 |
| 3,906,478 | 9/1975 | Smey | 340/279 |
| 4,875,030 | 10/1989 | Chiu | 340/575 |
| 4,953,111 | 8/1990 | Yamamoto et al. | 364/569 |
| 5,469,143 | 11/1995 | Cooper | 340/575 |
| 5,566,067 | 10/1996 | Hobson et al. | 364/569 |
| 5,585,785 | 12/1996 | Gwin et al. | 340/576 |
| 5,682,144 | 10/1997 | Mannik | 340/575 |
| 5,684,461 | 11/1997 | Jones | 340/575 |
| 5,745,038 | 4/1998 | Vance | 340/575 |
| 5,786,765 | 7/1998 | Kumakura et al. | 340/575 |
| 5,982,287 | 12/1997 | Brannen et al. | 340/575 |

*Primary Examiner*—Nina Tong
*Assistant Examiner*—Hung Nguyen

[57] ABSTRACT

A dual function sleep preventing system comprises a micro optic eyelid monitor, a micro optic tilting monitor, a signal combination circuits and an alarming unit. The eyelid monitor is placed in the vicinity of an eye by an appropriate mounting device when in use, using an emitter to transmit modulated appropriate light signals towards the eye, and using optic sensors to sense the influenced light by the eyelid, to detect the movement of eyelid. The tilting monitor comprises an optic tilt switch set on the side head of a user, using a micro optic monitor to detect a small ball's rolling in a closed tube system inside the switch when tilting. Both the monitors are connected to a signal combination circuits, which has an input signal filtering device, a switch part and a counter. The filtering device sets an appropriate time delay range to pick up dangerous long symptoms, base on signal length and the difference between a monitor signal's appearing time and another monitor's. The counter circuits records the times of those signals' occurrence. When finding such a symptom, the combination circuits will stimulate a pre-alarming immediately to detect the sleepy state of a user. A fully alarming will follow if the user has no response after a limited waiting time, or if the times of repeating pre-alarming reaches a criteria value set in the counter.

3 Claims, 6 Drawing Sheets

A

B

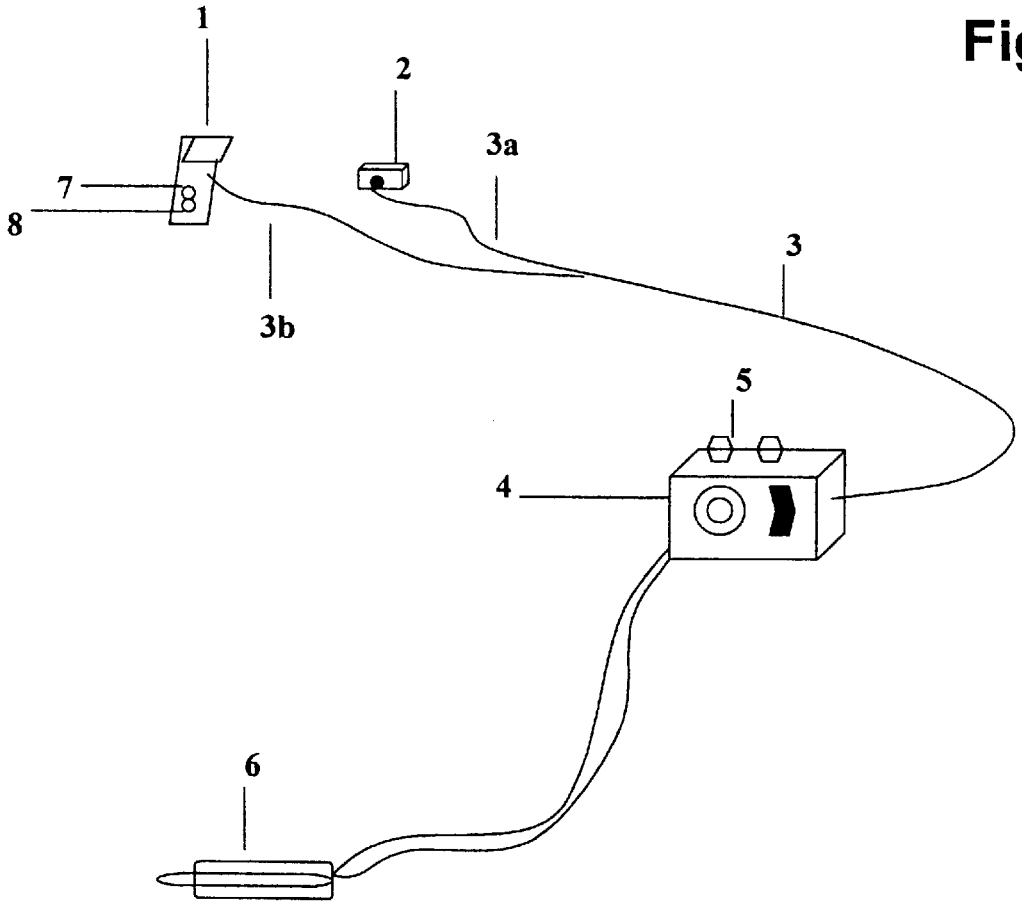
Fig. 1
Fig. 2
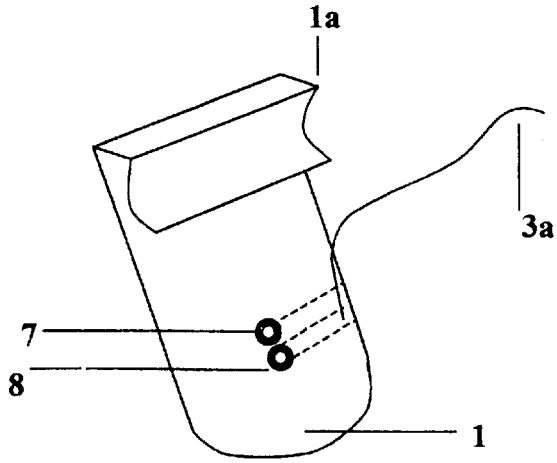

A

B

A

B

DUAL FUNCTION OPTIC SLEEP PREVENTING DEVICE FOR VEHICLE DRIVERS

BACKGROUND

1. Field of the Invention

This invention relates to sleep prevention devices, especially relates to multi function optic sleep prevention devices for vehicle drivers on wheel.

2. Description of Prior Art

The traffic records have shown that driver's falling asleep on wheel is a most dangerous accidence maker. A few seconds of sleep may cause deadly disaster to a high way driver while driving. Only in 1999, there were over 100,000 traffic accidents caused by sleepy drivers. In the past a few decades, especially in the past twenty years, a lot of efforts have been towards this problem. There have been many patents related to this subject published by now. Most concentrate on the following approaches: (1) Monitoring drivers' eyelid movement, such as U.S. Pat. Nos. 5,786,765, 5,745,038, 4,875,030, 1,863,243, etc.; (2) Detecting head's tilting, such as U.S. Pat. Nos. 5,684,461, 3,906,478, etc; (3) Sensing other body's symptoms, U.S. Pat. No. 5,585,785, etc. None of them has, however, become a commercial size of industry. There are some common difficulties for them. Firstly, a human body's performance is complicated, sometimes like a puzzle or a paradox. For example, closing eye for about 2–3 seconds during driving may be a dangerous sleeping symptom, or it may not be a symptom if the driver only nearly closes eyes for having a short relax or avoiding seeing too bright environment. And about 2–3 seconds' head's tilting may be very important, or may have no relation to sleepiness. Secondly, the detecting resolution of the monitors themselves may not meet the needs in some situations. For example, an eye-monitor is generally supposed to be carried by an eyeglass or a like, or installed in somewhere inside the driver chamber. It is hardly to accurately target the same position of an eye when in use. Also, the eye brow may influence the light signals when an eye is very nearly closed, so it is difficult for a monitor to verify the real fact. The detected results, however, are crucially important for an alarming system, and must be precisely made within a few seconds before too late, and only correct alarming is welcome by users.

In this paper patent application, the authors put forward a dual function optic sleep preventing device for drivers, based on monitoring both eyelid's movement and the head's tilting at the same time. The new system combines an optic eye-monitor with a micro optic tilt switch together to make a double check on a driver's sleeping symptom. The eye-monitor comprises an infra signal emitter and a sensing device. The tilt switch uses a micro optic monitor to detect the position of a small ball rolling in a small close tube inside the switch while tilting. Both the devices may be carried by an eyeglass or a like, or a head mounting device to set on a user's head when in use. When one monitor finds out a possible sleep symptom, the other will check the case independently at the same time. When the case is ascertained to be a dangerous one, a corresponding signal is created by a related circuits to stimulate an alarming unit. The alarming is principally divided into two levels: A pre-alarming and a fully alarming. The former is to test the state of a driver and further check if the driver needs a stronger warning. In the mean time, the number of the events is recorded by a counter. If the driver does response a pre-alarming, but repeats similar symptoms again and again and even more often afterwards, eventually reaching a predetermined number of times, or the driver does not response to a pre alarming for a certain limited waiting period of time, a fill alarming is immediately followed.

This present system has greatly improved the existing systems. An approximate estimation on the reliability of a dual system at early sleepy stage is as follows: if let u be the ratio of failure of a single eye-monitor, and v that of a tilt switch, the ratio by a dual monitoring system would be f=uxv. The corresponding reliability is then r=1−f. For example, if u=20% and v=20%, then f=4% and r=96%. In other words, the corresponding reliability of the present system would be greater than 95%. Even each single one is so bad with a failure ratio of 30%, we still may obtain a successful ratio of 91%.

OBJECTS AND SUMMARY OF THE INVENTION

It is a general object of the present invention to provide a highly effective and reliable sleep preventing device for vehicle drivers during driving.

It is a further object of the present invention to provide a highly effective and reliable optic dual function sleep preventing device on monitoring both eyelid's movement and head's tilting for drivers during driving.

It is a related further object of the present invention to provide a convenient micro size optic dual function sleep preventing device for vehicle drivers on wheel.

It is another object of the present invention to provide a highly manufacturing productivity optic dual monitoring sleep preventing device for drivers.

Other objects will become more apparent in the future cause of this application.

In accordance with the above objects, the present invention comprises a dual function optic monitoring system and an alarming system of two intensity levels.

The dual monitoring system comprises an optic eyelid monitoring device, an optic head's tilting detecting switch and a combination processing circuits. The eyelid device is designed for monitoring the movement of eyelid, using an emitter and a sensor. The emitter transmits modulated electromagnetic waves, and the sensor senses the changes in signal intensities influenced by the movement of the monitored eyelid. The tilt switch uses a micro optic monitor to detect a small metal ball's moving in a small closed tube inside the switch. If the user's head tilts, it brings the tube to tilt, causing the inside balls rolling. The ball will cut off the local light where the ball stays, and be sensed by a local sensor, so the tilting is reliably detected. Both the above monitors connected to a combination circuits, which has an input filtering unit, comprising a R-C network. The network provides a predetermined range of time delay to pick up dangerous long sleepy symptoms. Only those signals are able to stay for enough time to passing the filter, and build up a meaningful output to send to the alarming system followed. The alarming is principally divided into two different levels occurring in three situations. First, when a signal from the filter is sent to the alarming system, a pre-alarming is immediately stimulated, which is an intensity limited alarming to test the response of the driver. If the driver responds to it, opening eyes or turning back head to a non-tilt state, the alarming will be stopped automatically. In the mean time the event is recorded in a counter circuits. Second, if the driver does respond to a pre-alarming but repeats the dangerous symptoms again and again and even more often afterwards, eventually reaching a predetermined number of times, a strong, filly alarming will be stimulated to fresh the sleepy driver. Third, if a driver does not respond to a pre-alarming at all, a final alarming will be stimulated too after a certain limited waiting time, to prevent the deeply sleepy from totally falling asleep.

DESCRIPTION OF THE DRAWINGS

The present invention and its various objects and aspects may become more apparent from the following description of the preferred embodiments illustrated in the accompanying drawings:

FIG. 1 is a prospective front vies of the present invention.

FIG. 2 is a prospective rear view of an eyelid monitoring head.

Figure 3:
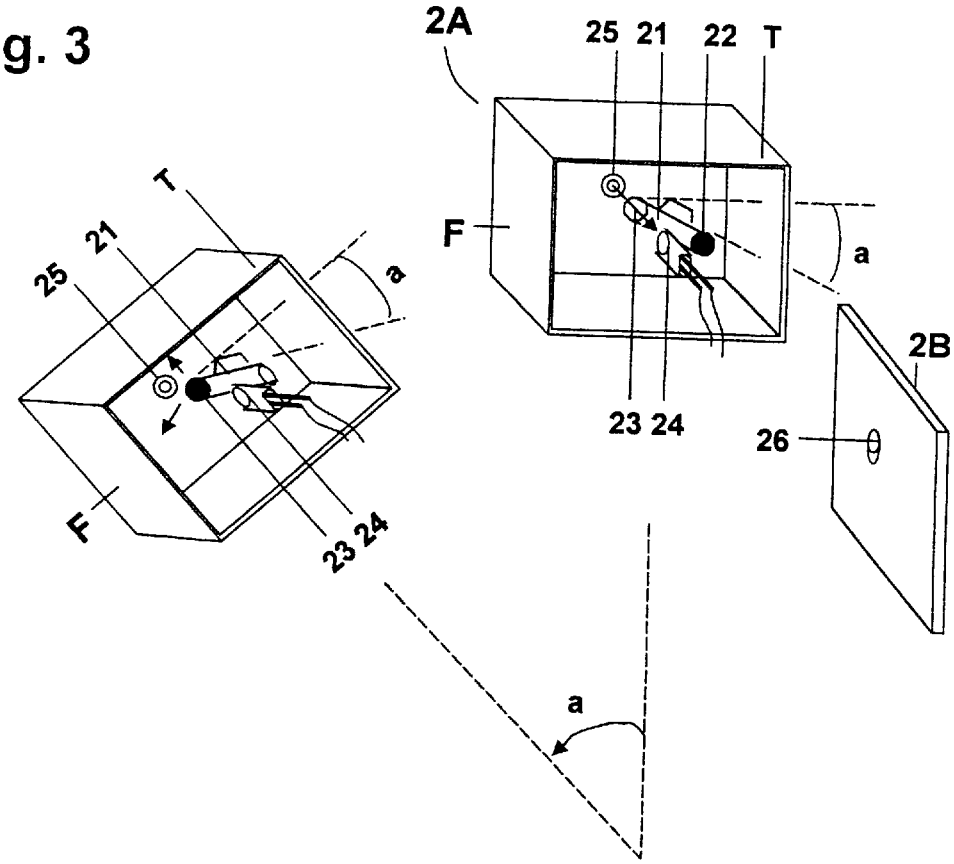
FIG. 3 is a prospective side view of a single level tilt switch in a tilting process.

The reference letters and numerals in the drawing are as follows:

1 is a mounting piece.
1a is a bending section of piece 1.
2 is a tilt switch.
3, 3a, 3b are electric wires.
4 is an alarming unit.
5 is a light display.
6 is a 12 v electric adapter.
7; 7s; 24; 33a, 33b are optic sensors.
8; 8s; 25; 34 are light emitters
9 is a front bridge of eyeglass.
10, 11 are two hinged side legs of eyeglass.
12 is a perpendicular piece of a head mounting device.
13 is a horizontal piece of a head mounting device.
14 is a front supporting piece of a head mounting device
15 is an adjusting button.
16 is a connecting slot.
21; 31 are switch tubes.
22; 32 are balls.
23 is the higher end region of tube 21.
26 is a mounting hole.
27 is a pulse generator.
28 is a signal processing circuits.
29; 53 are capacities.
30; 41, 43, 45, 46, 47; 51, 52, 54, 61, 64, 66 are resistance
35 is a curved mirror.
39 is a packaging box of a tilt switch.
40, 50 are output terminals.
42, 44 are display light emitters(LED).
48 is a fuse.
49 is a circuits.
56 is a counter circuits.
57 is a timer unit.
58 is an Or-Gate.
59, 60 are transistors.
62, 67 are diodes.
63, 68 are relays.
65 is a pressing switch.

-continued 80 is an alarming unit.
100 is a signal filtering unit.

DETAILED DESCRIPTION OF THE PREFERRED EMBODIMENTS

FIG. 1 shows the overlook of the present invention. This system has two small monitoring devices: an eyelid monitoring device(1) and a tilt switch device(2). Device 1 comprises an optic sensor(7) and a light emitter(8) carried by a mounting piece. Switch 2 is for monitoring a user's head's tilting. Both devices are connected to a circuit box(4) by two wires(3*a*, 3*b*) and a main wire(3). Box 4 has a warning light display(5) on its top, and an electric adapter(6), which fits the cigarette lighter source in the vehicle's driver chamber.

FIG. 2 shows a prospective rear view of the eyelid monitoring device. The eyelid monitor piece is bent at its top to make a hinging hook-like(1*a*). Both sensor 7 and emitter 8 are appropriately mounted in the lower part of the piece, and connected to main wire 3 by wire, 3*a*. When in use, piece 1 is properly placed in the vicinity of an eye to make both sensor 7 and emitter 8 target the an eyelid without preventing the eye's seeing. Emitter 8 will transmits appropriate, modulated infra signals towards the eye monitored The signals will be influenced by the eyelid and sensed by sensor 7. The movement of eyelid will change the intensities of the received signals and so to be detected by sensor 7 (See FIGS. 5, 6 and 7).

FIG. 3 shows a single level tilt switch. The two square container assemblies in the figure are the same switch, but at two different positions in a tilting process. The top one marked by letter 2A with a cover, 2B shows the complete structure of the switch, and corresponds to its non-tilt state with its top, T upwards. The switch has a closed transparent straight tube (21) installed at an angle, a with respect to the container top T, which is parallel to the ground in this state. Tube 21 has an opaque ball(22) in it, resting at the tub bottom. There are an optic sensor(24) and a light emitter(25) mounted substantially towards each other in the two opposite side walls of the container to target the higher end(23) of tube 21 between them. When the switch is turned on, emitter 25 transmits light towards region 23. The light passes region 23 to reach sensor 24. The latter produces an output to send to the switch circuits(, which is not shown in the figure.), reporting that region 23 is clear. The left, tilted container represents the position when the switch tilts forward to just over angle a. The tub bottom now becomes just higher than region 23, ball 22 rolls down to the latter and cuts off the light beam there and shades sensor 24. Sensor 24 will change its output. The tilting state of the switch is so to be detected.

It is clear that if we set sensor 7 on the same side as that the emitter is set on, to monitor the tube, sensor 7 will sense the reflected signals by the ball, we will still be able to detect the tilting.

Figure 4:
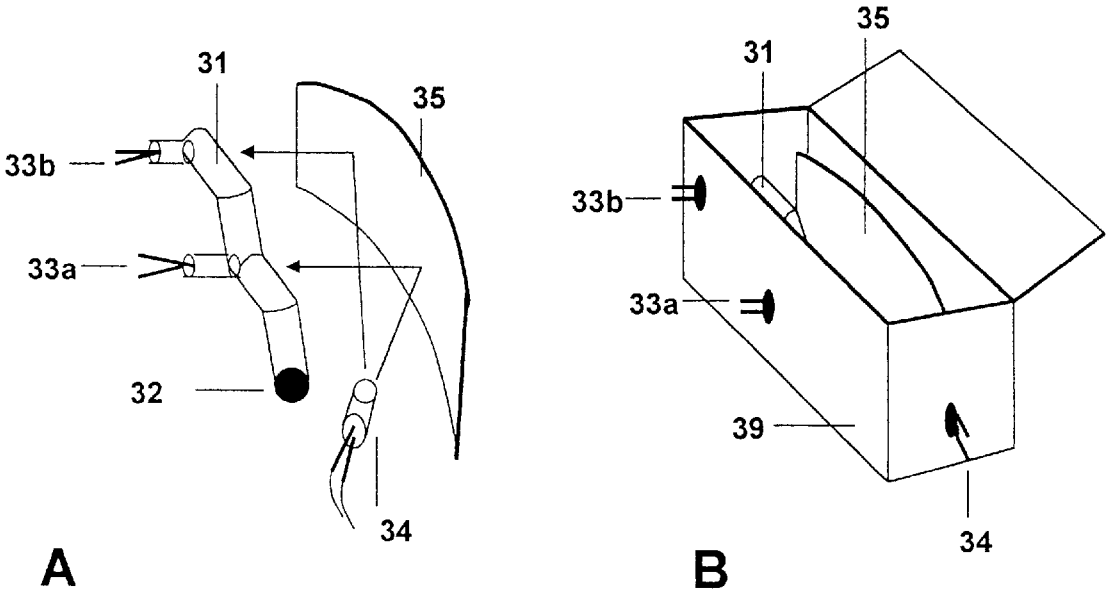
FIG. 4 is a prospective rear view of a double level tilt switch.

FIG. 4 shows a double level tilt switch. The switch tube(31) now has two step sections, holding a ball(32) in it Tube 31 creates two valley positions when tilts. There are two sensors(33*a* and 33*b*) are installed side by side from one side of tube 31 to monitor the two valley positions, respectively. A light emitter(34) is set at an appropriate position towards a papabolic type mirror(35), set on the other side of tube 31. When emitter 34 is turned on, it transmits light towards mirror 35, mirror 35 produces parallel reflected light towards the monitored two tube valley regions. The light will travel through the tube and reach both sensors 33*a* and 33*b* at the same time. When the switch tilts, it may cause ball 32 rolling down to a valley region, depending on the tilting angle, cutting off the local light there. The change in lights intensities is immediately sensed by the related sensor. Each valley corresponds a certain tilting level, thus the switch is able to detect two tilt levels.

Figure 5:
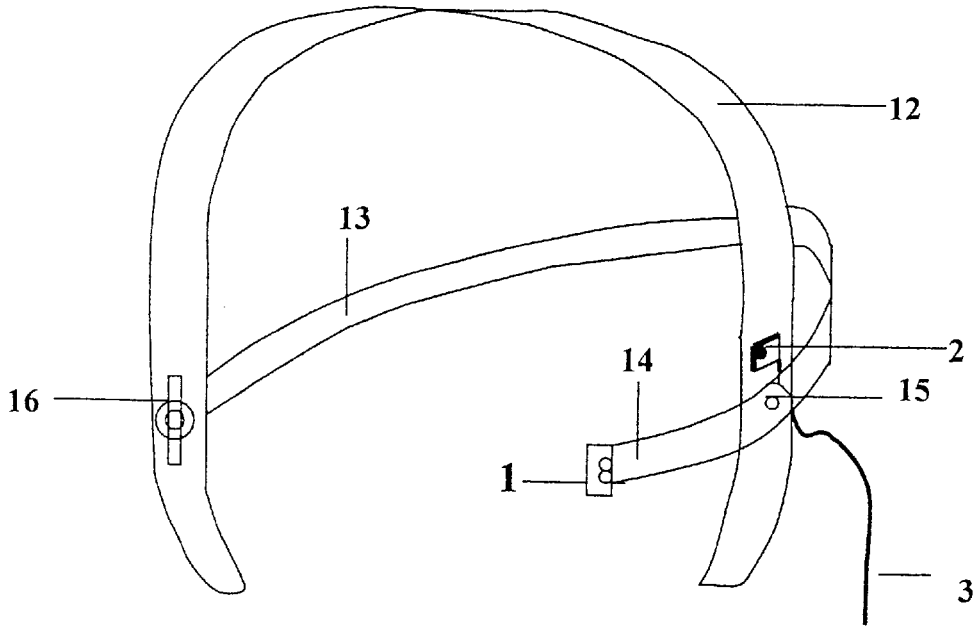
FIG. 5 is a prospective front view of the present invention when installed on a head mounting device when in use.
Figure 5:
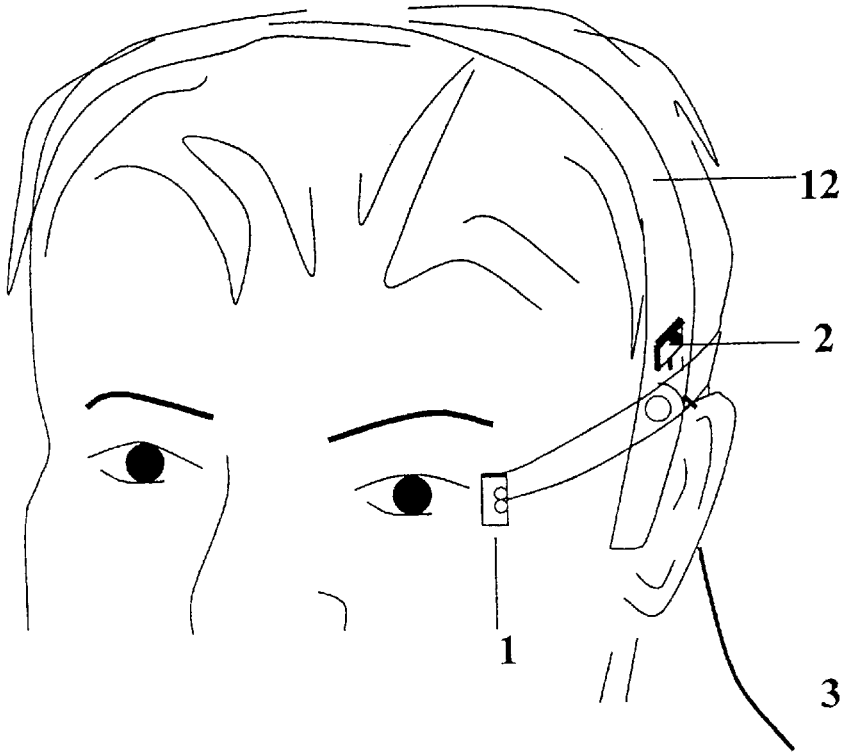

FIG. 5 shows a head mounting device for carrying the above two monitoring devices of FIG. 1: FIG. A shows the overlook of the present invention when carried by a head mounting device. which has a perpendicular piece(12), a rear piece(13) and a front side piece(14), assembled together by connecting buttons, 15 and 16. Eyelid monitoring piece 1 is mounted at the front end position of piece 14. Tilt switch 2 mounted on the side position. FIG. B shows the way of using the dual system when set on a user's head. Tilt switch 2 is set on the user's side head. Eyelid monitoring head 1 is set in the vicinity of an eye to target it substantially without preventing the viewing.

Figure 6:
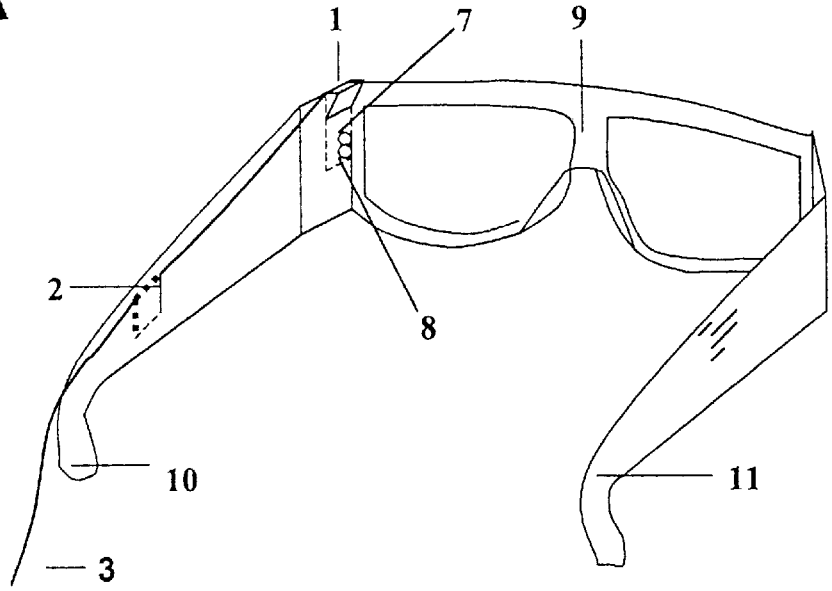
FIG. 6 is a prospective rear view of the present invention when carried by a pair of glass when in use.
Figure 6:
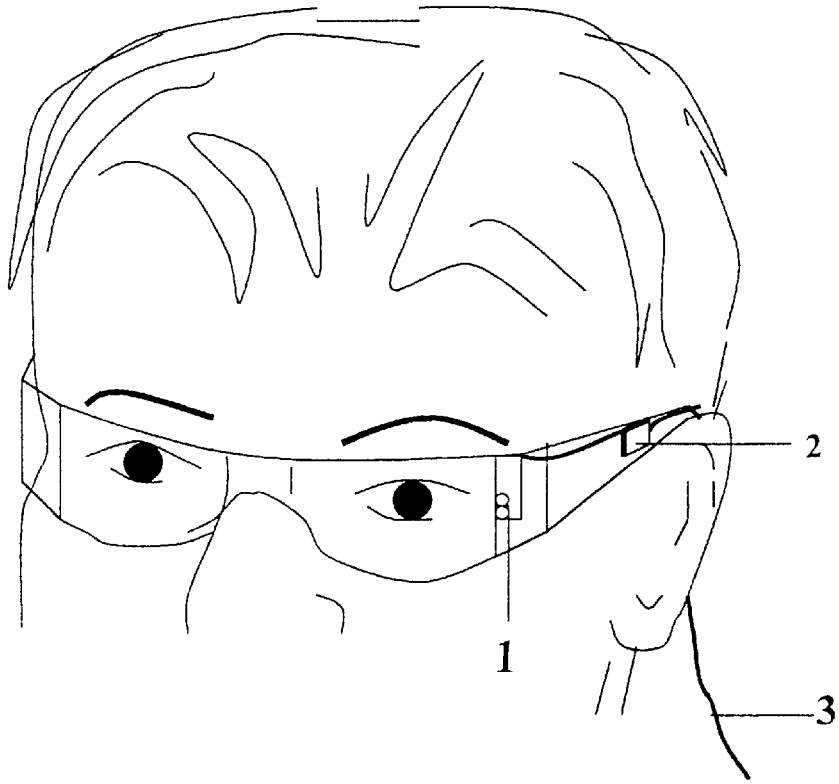

FIG. 6 shows another convenient way of using the present invention. Both eyelid monitoring head and tilt switch are set on the frame of an eye glass. Piece 1 is hung on a front side corner of the glass frame. Tilt switch 2 is mounted on a side leg of the eyeglass.

Figure 7:
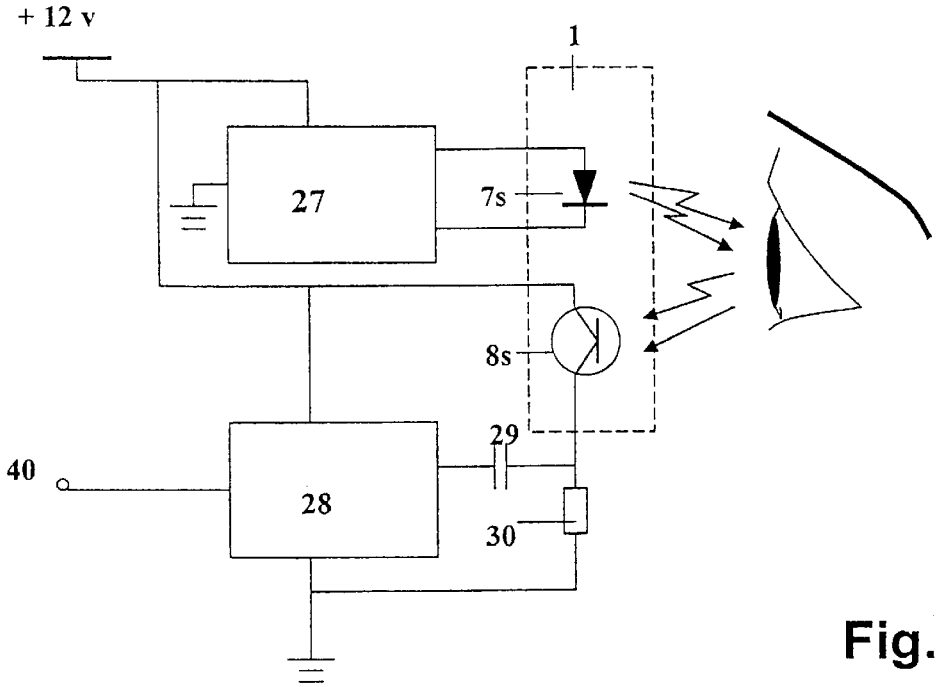
FIG. 7 is a circuit block diagram of the eyelid monitoring system of the present invention.

FIG. 7 shows the signal processing diagram of eyelid monitor of FIG. 1. A diode, 7*s* represents an infra emitter. It will be placed towards an eye, as mentioned in FIGS. 5–6 when in use. The signal emitted by diode 7*s* is modulated by a pulse generator, 27 and will be reflected by the monitored eyelid and sensed by sensor 8*s*. When sensor 8*s* receives signals, it produces photo-current signals to be sent to a circuits, 28. The signals go through an input capacity, 29, which filters off the constant background light. Circuits 28 amplifies the signals, and sends its output to terminal, 40. Actually an eyelid reflects more light than an eyeball does, so a high level output corresponds to a closed eye, and a low output level to an opened eye.

Figure 8:
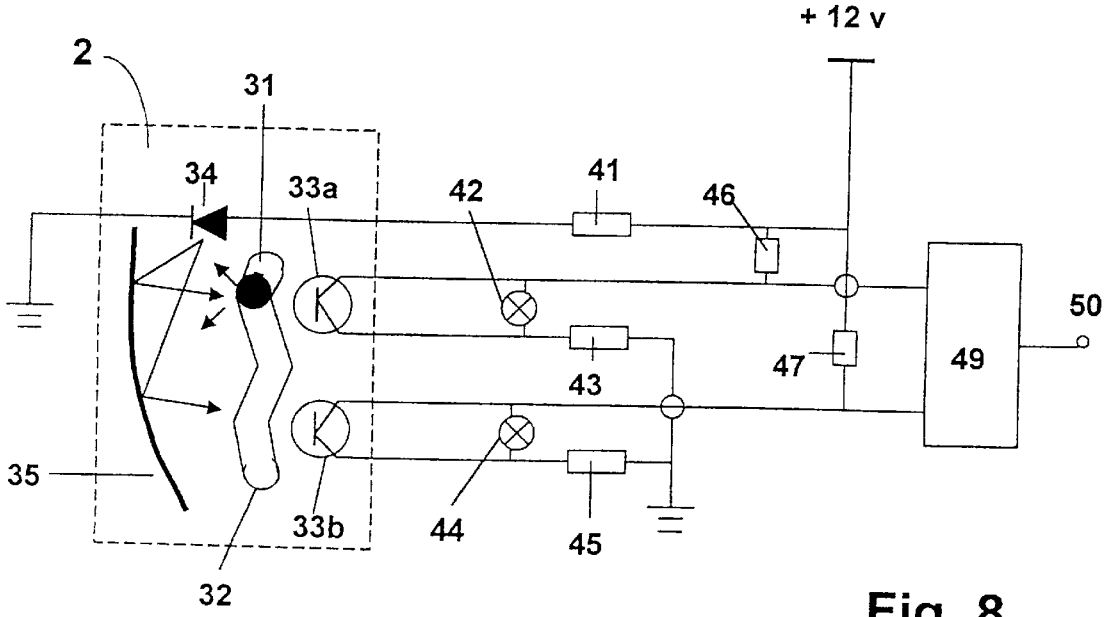
FIG. 8 is a circuit block diagram of the tilt monitoring system of the present invention.

FIG. 8 shows the tilt signals' processing. The dash line block represents a two tilt level switch, as shown in FIG. 4, having closed tube 31, ball 32, emitter 34, and two optic sensors, 33*a*, 33*b*. Emitter 34 is connected to a protecting resistance, 41. Both sensors 33*a* and 33*b* are connected two signal display emitters(LED), 42, 44 in parallel. Each sensor has a load resistance, 46(or 47) to pick up its output. Both the pieces of resistance are connected to a circuits, 49, which has a final output terminal, 50.

When the switch stays in its closed state, ball 32 stays at tube bottom, leaving all the monitored valley positions clear, as mentioned in FIG. 4, both sensors 33*a* and 33*b* receive maximum light from the signal source, creating maximum photo-current in their circuits, so as to produce a low level output at both load resistance 46, 47, respectively, at the same time. Both signals go to circuit 49, a final low level output is sent to terminal 50. When the switch tilts and makes ball 32 roll to a valley region, such as the first valley, as shown in the figure, sensor 32*a* will be shaded by the ball and receive minimum light from the source, producing a high level output at its load resistance 46 to send to circuit 49, producing an high output at terminal 50. If the switch continues tilting, it may cause ball 42 rolling to the second valley region of tube 31 from the first valley region, and so to shade sensor 32*b*. A similar process will happen and a final high level output will occur at terminal 50. If the switch turns back to its non-tilt state, it tuns output to a low output level at terminal 50 again.

Figure 9:
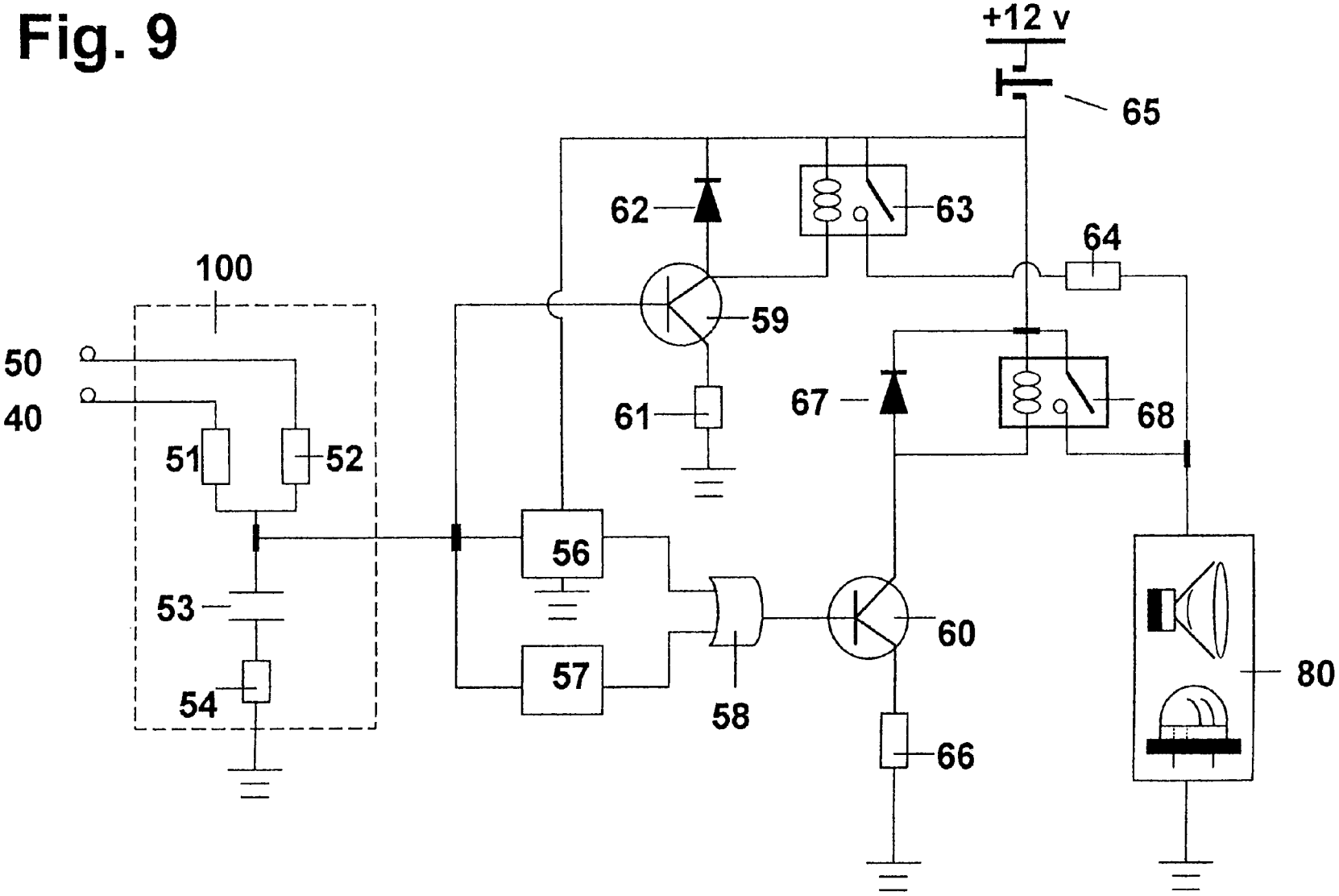
FIG. 9 is a circuit diagram of the alarming system of the present invention.

FIG. 9 shows the circuit diagram of a sample alarming system of the present invention. The system has an input signal filtering device, 100, which is a R-C network consisted by a capacity(53) and three pieces of resistance(51, 52, 54) creating an appropriate time delay range for input signals. Filter 100 has two input terminals from resistance 51 and 52, for receiving signals from terminal 40 of FIG. 7 and terminal 50 of FIG. 8, respectively. The output of device 100 is picked up at capacity 53, which goes to a transistor (59), a timer unit(57) and a counter unit(56). Transistor 59 has an output relay(63) to handle an alarming unit(70) through an adjustable current-limitation resistance(64). Timer 57 sets a time delay for any signals from device 100 to pass. Both timer 57 and circuits 56 are connected to an Or-Gate(58). Gate 58 goes to a second transistor(60), which has an output relay(68), handling unit 70 to by-pass resistance 64.

A whole monitoring process is as follows: When eye-monitor 1 of FIG. 7 or tilt monitor 2 of FIG. 8, or both find a symptom from a driver while driving, they immediately create output at their terminals 40, 50, respectively. The signal pair is sent to filter 100 to be examined. Unit 100 uses its time delay to filter the input signals. The time delay of filter 100 is the time needed for input signal pair to build up a meaningful(or saturated) output voltage over capacity 53 by feeding enough electricity to the capacity. All shorter input signals than the time delay are not able to a real output, so as to be consumed up. This is just we want that a drive of showing short signal of closing eye or tilting head does not need an alarming. When a signal pair is longer than the time delay of filter 100, it will be able to build an output at capacity 53 and further go to transistor 59, called a 'dangerous symptom'. When receiving such a signal, transistor 59 closes relay 63 and stimulates unit 70 by turning it on to the energy source through resistance 64. Unit 70 immediately sends alarming signals to check the state of the driver. The alarming intensity of device 70 is limited by resistance 64, called a pre-alarming. If such a pre-alarming is responded to by the driver, with opening the eyes and turning back the head to normal position to make symptom disappear, the alarming will be stopped automatically. In the mean time, the event is recorded by counter circuits 56. A sleepy driver may repeat the similar symptom again and again, and maybe even more often afterwards. If the driver does so, and repeats the symptoms for a predetermined number of times, correspondingly, counter 85 will produce a warning signal by itself to send to transistor 60 through gate 58. Transistor 60 will immediately stimulate a much stronger alarming by turning unit 70 on the energy source directly without passing resistance 64, called a formal alarming. The alarming intensity is set strong enough to wake up a deeply sleepy driver.

On the other hand, if the driver does not respond to a pre-alarming, the warning signal may continue passing timer delay 57 and gate 58 to reach transistor 60. A formal alarming is stimulated, too.

The time delay of filter 100 varies in a predetermined value range, according to the actual timing process of a signal pair: The shorter the difference between the appearing time of a monitor signal and that of the other one is, the shorter the time delay is. The shortest time delay occurs when both signals of a pair occur at the same time. In this case, both input feed electricity to capacity 53 in a parallel way through resistance 51 and 52 from very beginning, creating the highest speed to establish the output. This corresponds to the most dangerous case that the driver closes eyes and deeply tilts head at the same time on wheel for a dangerous long period of time. The driver must be warned before too late. Properly choosing the value of each component of filter 100, a satisfactory delay time range can be set up, such as 2–3 seconds, or so.

In the above system, both transistors 59 and 60 actually play a role of switch for tuning on relay 63 and 68. All these devices make a stimulating switch unit, and also this unit and filter 100 make a whole signal combination processing circuits.

The Spirit and the Scope of the Present Invention

The present invention comprises a micro optic eyelid monitor, a micro optic tilting monitor, a signal combination circuits and an alarming unit. The eyelid monitor is placed in the vicinity of an eye by an appropriate mounting device when in use. It uses an emitter to transmit appropriate, modulated light signals towards the eye, and uses optic sensors to sense the influenced light by the eyelid, to detect the movement of eyelid. The tilting monitor comprises an optic tilt switch set on the side head of a user by the same mounting device, using a micro optic monitor to detect a small opaque ball's rolling in a closed tube system inside the switch when tilting. Both the monitors are connected to a signal combination circuits, comprising an input filtering device, a stimulating switch unit and a counter circuits. The filtering device sets an appropriate time delay range to pick up dangerous long symptoms, base on the signal length and the difference between a monitor signal's appearing time and another monitor's. The counter circuits records the times of those signals' occurrence. As soon as finding such a symptom, the circuits sends a warning signal to the alarming unit to stimulate a pre-alarming to detect the sleepy state of a user. A fully alarming will follow if the user has no response to a pre-alarming, or if the times of repeating pre-alarming reaches a criteria value set in the counter.

It is understood that changes in monitors, mounting device, circuits, alarming system, materials, size, decorations without changing the functions will not depart from the spirit and the scope of the present invention.

We claim:

1. An optic dual function sleep preventing system, working on an electric energy source and carried by a mounting device to set on a user's head when in use, comprising:

a dual monitoring system, including:

an optic eyelid monitor properly set in the vicinity of an eye of said user by said mounting device to monitor the movement of the eyelid of said eye when in use, comprising: an emitter for transmitting appropriate, modulated electromagnetic waves towards said eye; and a predetermined number of optic sensors for sensing the influence on the intensities of received portion of said waves by said movement of said eyelid, such that when said movement occurs to change said intensities, it is detected by said monitor and a corresponding output is created by said monitor;

a head tilting monitor set on the side of the head of said user carried by said mounting device when in use for detecting a head's tilting, comprising an optic tilt switch using a micro optic monitor to detect a small ball's rolling in a closed tube system inside said switch due to said tilting; when said tilting causes said ball's rolling to different positions inside said tube system, the intensity of said waves in the regions of said positions, also changes so as to be detected and a corresponding output is created by said tilt switch.

2. An optic dual function sleep preventing system of claim 1, further comprising: a combination processing circuit, including: an input filtering device, having two input terminals for receiving said eyelid monitor and said head's tilting switch, respectively and one output terminal for sounding warning signals, comprising a R-C network creating a predetermined range of time delay for input signals with the value of said time delay properly varied as the difference between the appearing moment of a first signal from said eyelid monitor and a second from said head titling monitor during an event varies, such that either one of said first and second signals or both said first and second signals are longer than the corresponding time delay are able to pass said filtering device and establish an output signal of said filtering device.

3. An optic dual function sleep preventing system of claim 1, further comprising: an alarming system including:

an alarming unit;

an pre-alarming circuit, including: a stimulating switch unit for turning on said alarming unit on said energy source under a predetermined condition of limiting the stimulating power supply, when receiving an input signal from said filtering device a formal alarming circuit configuration, including:

a second stimulating switch unit for turning on said alarming unit under releasing said predetermined condition of said power supply when receiving an input signal from said pre-alarming circuit;

a timer having a predetermined time delay, connected between said second stimulating switch unit and said filtering device for appropriately delay signals from said filtering unit to send to said second switch unit;

a counter circuits connected between said second stimulating switch unit and said filtering device for counting the times of sending output signals by said filtering device, such that when said recorded times reaches a predetermined number, said counter circuits produces a signal to send to said second switch unit.

* * * * *